US010179679B2

(12) United States Patent
Agassi et al.

(10) Patent No.: US 10,179,679 B2
(45) **Date of Patent: *Jan. 15, 2019**

(54) SEALABLE POURER

(71) Applicant: AGAM INNOVATIONS LTD., Netanya (IL)

(72) Inventors: Or Agassi, Tel Aviv (IL); Reuven Marko, Netanya (IL)

(73) Assignee: Agam Innovations Ltd., Netanya (IL)

( * ) Notice: Subject to any disclaimer, the term of this patent is extended or adjusted under 35 U.S.C. 154(b) by 0 days.

This patent is subject to a terminal disclaimer.

(21) Appl. No.: 14/589,596

(22) Filed: Jan. 5, 2015

(65) Prior Publication Data

US 2015/0122839 A1 May 7, 2015

Related U.S. Application Data

(63) Continuation of application No. 13/252,345, filed on Oct. 4, 2011, now Pat. No. 8,944,297, and a continuation-in-part of application No. 29/394,407, filed on Jun. 16, 2011, now Pat. No. Des. 678,768.

(60) Provisional application No. 61/391,101, filed on Oct. 8, 2010.

(51) Int. Cl.

| | |
|---|---|
| ***B65D 47/12*** | (2006.01) |
| ***B65D 47/26*** | (2006.01) |
| ***B65D 47/28*** | (2006.01) |
| ***B65D 47/32*** | (2006.01) |

(52) U.S. Cl.

CPC ..... *B65D 47/12* (2013.01); *B65D 47/263* (2013.01); *B65D 47/283* (2013.01); *B65D 47/32* (2013.01)

(58) Field of Classification Search

CPC .... B65D 47/12; B65D 47/263; B65D 47/283; B65D 47/32

USPC ..... 222/481.5

See application file for complete search history.

(56) References Cited

U.S. PATENT DOCUMENTS

| | | | | |
|---|---|---|---|---|
| 2,112,125 | A | 3/1938 | Bruno | |
| 2,163,555 | A | 6/1939 | Geyer et al. | |
| 2,642,207 | A | 6/1953 | Renzi | |
| 2,717,727 | A | 9/1955 | Robb | |
| 2,968,423 | A | 1/1961 | Mahler et al. | |
| 3,198,406 | A | 8/1965 | Kopelman | |
| 3,263,871 | A * | 8/1966 | Thompson | B05B 11/0072 222/205 |
| 3,317,093 | A * | 5/1967 | Moran | B65D 47/24 222/484 |
| 3,630,419 | A | 12/1971 | Pierce | |
| 3,796,348 | A | 3/1974 | Zipper | |

(Continued)

OTHER PUBLICATIONS

Second Office Action for Chinese Patent Application No. 201180048571.7, State Intellectual Property Office of the P.R. C., dated Apr. 3, 2015.

(Continued)

*Primary Examiner* — Jeremy Carroll

(74) *Attorney, Agent, or Firm* — M&B Analysts, LLC

(57) ABSTRACT

A sealable pourer for mounting on a bottle is provided. The sealable pourer includes a cap to ensure that the pouring nozzle and air tube outlet are sealed, or otherwise closed, when in a first position of the cap and allow free flow of the liquid content of the bottle when in a second position. In one embodiment, the cap is rotated about a symmetry axis of the nozzle to achieve sealing of both the air passage and the pouring nozzle.

10 Claims, 12 Drawing Sheets

(56) References Cited

U.S. PATENT DOCUMENTS

| | | | | |
|---|---|---|---|---|
| 3,894,661 | A | 7/1975 | Guala | |
| 4,261,484 | A | 4/1981 | Dacosta et al. | |
| 4,376,497 | A * | 3/1983 | Mumford | B65D 50/046 215/216 |
| 4,384,662 | A | 5/1983 | Boudin et al. | |
| 4,523,687 | A | 6/1985 | Hullihen | |
| 4,877,159 | A * | 10/1989 | Strand | B67D 3/043 222/484 |
| 4,984,711 | A | 1/1991 | Ellis | |
| 5,211,318 | A | 5/1993 | Govatzidakis | |
| 5,303,839 | A | 4/1994 | Blumenschein | |
| 5,303,850 | A * | 4/1994 | Connan | B65D 47/263 215/253 |
| 5,346,099 | A | 9/1994 | Salmon et al. | |
| 5,713,491 | A | 2/1998 | Hughes et al. | |
| 5,960,992 | A | 10/1999 | Bernstein et al. | |
| 5,961,008 | A | 10/1999 | Peckels | |
| 6,123,225 | A | 9/2000 | Peckels | |
| 6,149,022 | A | 11/2000 | Akyildiz et al. | |
| 6,364,178 | B1 | 4/2002 | Paczonay | |
| 6,568,660 | B1 | 5/2003 | Flanbaum | |
| 6,742,678 | B1 | 6/2004 | Krystopik | |
| 7,040,515 | B2 | 5/2006 | Cote | |
| 7,237,692 | B2 | 7/2007 | Bodum | |
| 7,407,067 | B2 | 8/2008 | Kerkhof et al. | |
| D587,571 | S | 3/2009 | Gonzales, Jr. | |
| D591,594 | S | 5/2009 | Jalet | |
| 7,622,039 | B2 | 11/2009 | Farrell et al. | |
| 7,806,303 | B1 | 10/2010 | Hastings | |
| D633,753 | S | 3/2011 | White | |
| 8,011,540 | B1 | 9/2011 | Peckels | |
| 8,505,760 | B2 | 8/2013 | Ott | |
| 2005/0194410 | A1 | 9/2005 | Pham | |
| 2006/0000855 | A1 * | 1/2006 | Allen | B65D 47/06 222/484 |
| 2008/0017675 | A1 * | 1/2008 | Pressey | B65D 41/26 222/481.5 |
| 2008/0073383 | A1 | 3/2008 | McDonald | |
| 2008/0099514 | A1 | 5/2008 | Carter et al. | |
| 2008/0237178 | A1 | 10/2008 | Laburu | |
| 2008/0272147 | A1 | 11/2008 | Buker et al. | |
| 2009/0008356 | A1 | 1/2009 | Gadzic et al. | |
| 2010/0006590 | A1 | 1/2010 | Withoos et al. | |
| 2010/0038378 | A1 | 2/2010 | Gabler et al. | |
| 2010/0091605 | A1 | 4/2010 | Rasmussen et al. | |
| 2010/0230447 | A1 | 9/2010 | Eriksen | |
| 2011/0024383 | A1 | 2/2011 | McKenna et al. | |
| 2011/0024453 | A1 | 2/2011 | Fleisher | |
| 2011/0024925 | A1 | 2/2011 | Mauffette | |
| 2011/0163119 | A1 | 7/2011 | Nyambi et al. | |
| 2011/0297705 | A1 * | 12/2011 | Albers, Jr. | B65D 47/263 222/553 |

OTHER PUBLICATIONS

Chilean Office Action No. 919-13 for Patent Application in Chile No. 2013-00919, dated Dec. 18, 2015, Chilean Patent Office, Chile.

International Search Authority: "Written Opinion of the International Searching Authority" (PCT Rule 43bis.1) including International Search Report for International Patent Application No. PCT/IL 11/00783; dated May 4, 2012.

Office Action, Japanese Patent Office, Japanese Patent Application No. 2014-503274, Mailing No. 549509, dated Oct. 21, 2014.

Office Action, State Intellectual Property Office of the P.R.C., Chinese Patent Application No. 201180048571.7, Issue Document No. 2014082800538200, dated Sep. 2, 2014.

Patent Examination Report No. 1, Australian Patent Application No. 2011371175, Australian Government Patent Office, dated Sep. 26, 2014.

Technical Examination, Colombian Patent Office, Patent Application in Columbia No. 13-089623, PCT/US2011/025669, dated Aug. 1, 2014

Office Action from the Chilean Patent Office dated Jul. 22, 2016 for Chilean Patent Application No. 2013-00919.

* cited by examiner

SEALABLE POURER

CROSS-REFERENCE TO RELATED APPLICATIONS

This application is a continuation of U.S. patent application Ser. No. 13/252,345 filed on Oct. 4, 2011, now allowed, which claims the benefit of U.S. provisional application No. 61/391,101 filed on Oct. 8, 2010. The Ser. No. 13/252,345 application is also a continuation-in-part of U.S. design application No. 29/394,407 filed on Jun. 16, 2011 now U.S. Pat. No. D678,768. The contents of the above-referenced applications are incorporated herein by reference.

TECHNICAL FIELD

The disclosure relates to a pourer that is placed on a container (for example, a bottle), for the dispensing of liquids. More specifically, the disclosure relates to a pourer where both an air opening and a liquid opening are sealable or otherwise closeable.

BACKGROUND

Generally, pourers have a nozzle that is used for the dispensing of liquid and is typically formed as a tube in some form or shape. The pourer further generally contains an air tube that allows air to enter the container as liquid is dispensed; otherwise, the flow of the liquid may be disrupted, as is well known in the art.

When dispensing beverages such as alcoholic beverages, a pourer is placed on the bottle for the purpose of making it easier for the person pouring the beverage to dispense the beverage quickly and efficiently. Typical pourers are not sealable and remain open. The problem of leaving the pourer on the bottle is that at the end of the work day it is necessary to somehow seal the pourer to prevent insects from entering the bottle as they are drawn to the sugars associated with the presence of such alcoholic beverages or other beverages which may then render the bottle useless for future use.

U.S. Pat. No. 3,630,419 partially addresses the problem by placing a lid on the nozzle such that, when the bottle is tilted, the lid opens and allows for the flow of liquid while when placed vertically the lid, due to gravity, closes. To ensure that the air tube is also sealed, the opening of the air tube is inside of the pouring nozzle which, when a significant amount of beverage is dispensed at a time, may block openings, thereby disrupting the regular flow of the liquid. This is particularly disadvantageous for bartenders, whose income relies at least in part on quickly dispensing alcoholic beverage. No other prior art seems to solve the problem effectively.

In view of the shortcomings of the prior art, it would be advantageous to effectively seal both the pouring nozzle and the air tube of a pourer. It would be further advantageous if such a solution would not impact the efficiency of the work of a bartender. It would be further advantageous if the air tube opening would not be inside the nozzle tube.

SUMMARY

Certain embodiments disclosed herein include an apparatus for controlled pouring of a liquid. The apparatus comprises a hollow cone-shaped nozzle having a nozzle orifice through which the liquid is poured, wherein the nozzle has a rotational symmetry at least with respect to outer walls of the nozzle; an air tube protruding from the nozzle at a side that is opposite to the nozzle orifice, wherein the air tube allows at least an air flow when liquid is poured through the nozzle orifice; and a cap engaged with the nozzle having a first cap orifice generally conforming in shape to the nozzle orifice and a second cap orifice generally conforming in shape to the protruding air tube, wherein the second cap orifice is arranged in a longitudinal direction on the cap, an internal hollow of the cap having inner walls tightly conforming to the cone-shaped outer walls of the nozzle at any rotational position of the cap about the nozzle, the cap having a first position about the nozzle wherein the first cap orifice is not aligned with the nozzle orifice and the second cap orifice is not aligned with the protruding air tube, and the cap having a second position about the nozzle where the first cap orifice is aligned with the nozzle orifice and the second cap orifice is aligned with the protruding air tube of the nozzle, wherein, when the cap is in the first position, the liquid cannot be poured through the apparatus, and when the cap is in the second position, the liquid can be poured through the apparatus.

BRIEF DESCRIPTION OF THE DRAWINGS

The subject matter disclosed herein is particularly pointed out and distinctly claimed in the claims at the conclusion of the specification. The foregoing and other objects, features and advantages of the disclosed embodiments will be apparent from the following detailed description taken in conjunction with the accompanying drawings.

DETAILED DESCRIPTION

Certain exemplary embodiments include a sealable pourer for mounting on a bottle. The sealable pourer is equipped with a cap to ensure that the pouring nozzle and air tube outlet are sealed, or otherwise closed, when in a first position of the cap, and to allow free flow of the liquid content of the bottle when in a second position. In one embodiment, the cap is rotated about a symmetry axis of a cone shaped nozzle to achieve sealing of both the air passage and the pouring nozzle.

Figure 1:
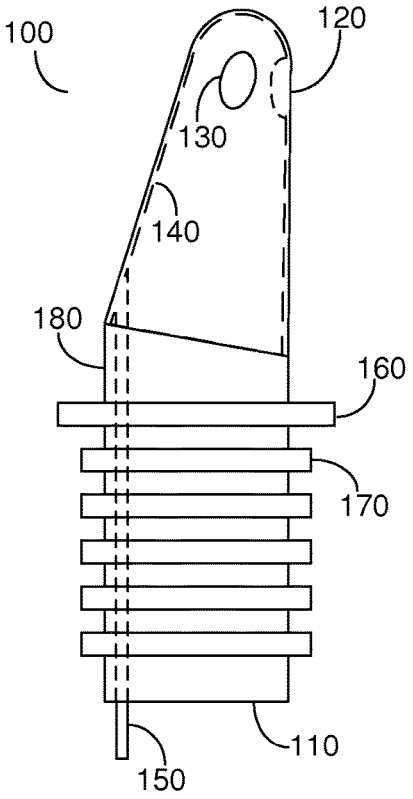
FIG. 1 is a schematic diagram of a pourer in accordance with an embodiment from a front side showing the sealing of the liquid nozzle by a twisting cap.
Figure 2:
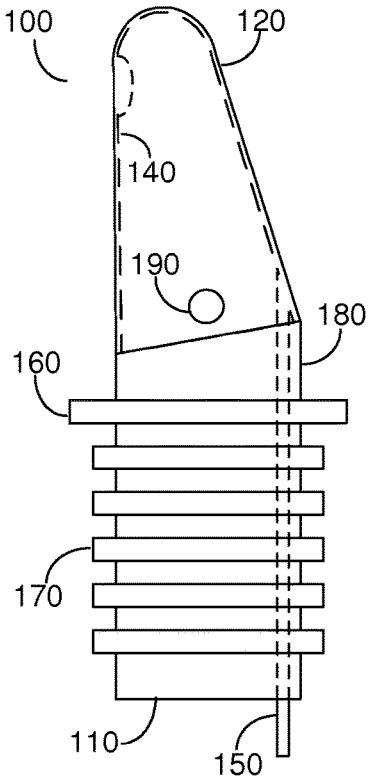
FIG. 2 is a schematic diagram of the pourer from a back side showing the sealing of the air tube by a twisting cap.
Figure 3:
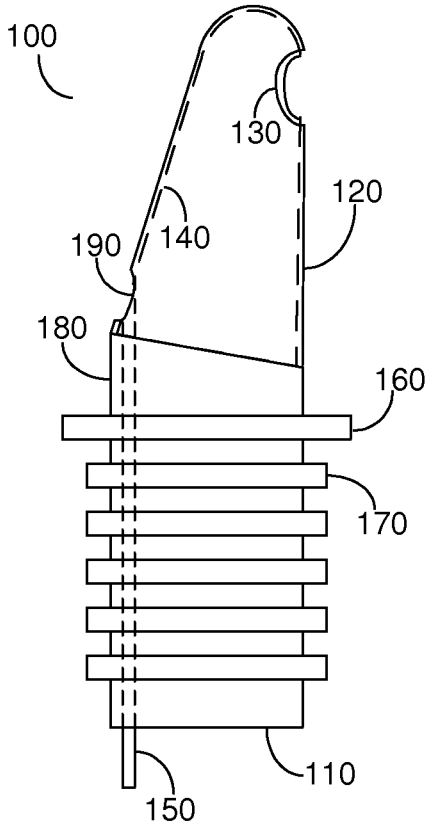
FIG. 3 is a schematic diagram of the pourer in an opened (dispense) position by a twisting cap.

Reference is made to FIGS. 1, 2, and 3, where exemplary and non-limiting schematic diagrams of a pourer 100 implemented in accordance with an embodiment is shown. FIG. 1 depicts the pourer 100 from a front view in the sealed position. The pourer 100 is comprised of a fixture 110 that is hollow and equipped with engaging elements 170 that secure the pourer 100 in a bottle's neck (not shown). The fixture 110 is affixed to a base 180, also hollow, that is further equipped with a stopper 160. The base 180 provides a tilting of the nozzle as further explained herein below. The stopper 160 allows for sealing of the bottle opening once the pourer is inserted all the way in, and further prevents pushing the pourer into the bottle beyond a predefined position.

A nozzle 140 is affixed to the base 180 and is also hollow. It has a nozzle orifice that allows liquid to flow from the bottle through the hollow fixture 110 and through the hollow base 180 so that the liquid can be dispensed from the bottle. In an embodiment, the nozzle 140 is cone-shaped. An air tube 150 is affixed to the nozzle 140 and protrudes through the nozzle 140 such that the airflow is not impacted by the flow of liquid inside of the nozzle 140.

A cap 120 mounted over the nozzle 140 allows for sealing of the nozzle 140. The cap 120 includes a first cap orifice (or opening) 130 generally corresponding to the nozzle orifice in the nozzle 140 in size and a second cap orifice (or opening) 190 generally corresponding to the opening in the nozzle 140 resulting from the protrusion of the air tube 150 through the side of the nozzle 140.

The cap 120 is rotatable about a symmetry axis of the nozzle 140. In an embodiment, the cap 120 is horizontally rotatable about a symmetry axis of the nozzle 140 between two positions, one of which includes a stopper (e.g., the stopper 160). In FIG. 1, a front view of the pourer 100 is shown where the cap is in a position where the first cap orifice 130 is not aligned with the corresponding nozzle orifice in the nozzle 140. This is achieved, for example, by twisting the cap 120 sufficiently to achieve this goal, for example by 90 degrees. Similarly, in FIG. 2, a back view of the pourer 100 is shown where the cap is in a position where the second cap orifice 190 is not aligned with the corresponding air tube orifice for the air tube 150. The result is that, in this position, the pourer is sealed and the liquid content cannot be poured.

In FIG. 3, the cap 120 is twisted such that the first cap orifice 130 is aligned with the nozzle orifice in the nozzle 140 and the second cap orifice 190 is aligned with an air tube orifice of the air tube 150. In this position, liquid may be easily dispensed from the pourer 100. It should also be understood that, while a cone design is shown in FIGS. 1-3, other designs may be used without departing from the various disclosed embodiments. However, this solution is highly suitable for symmetrical nozzles.

Figure 4:
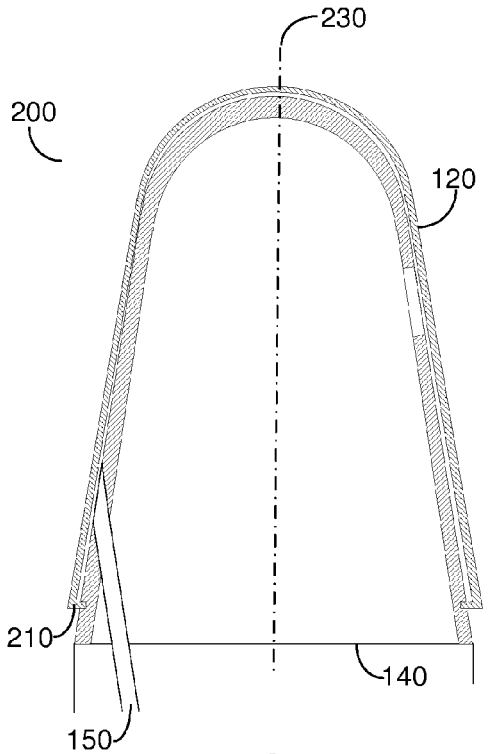
FIG. 4 is a cross section of a portion of the pourer in a sealed position by a twisting cap.
Figure 5:
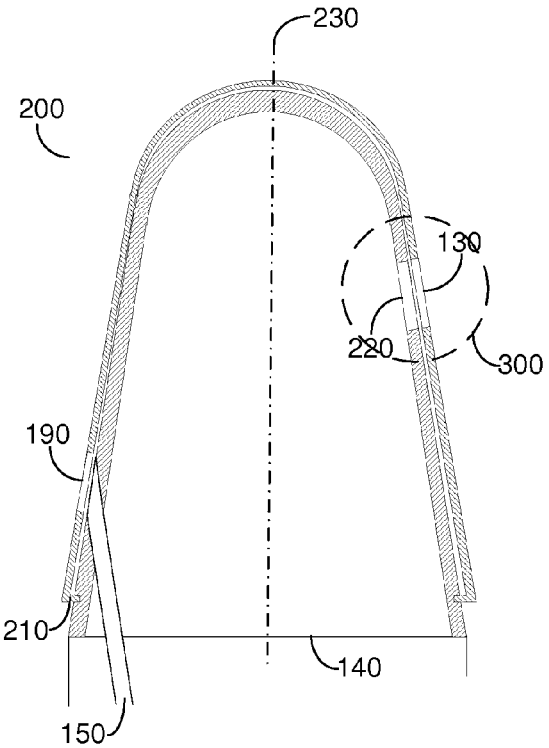
FIG. 5 is a cross section of a portion of the pourer in an opened position by a twisting cap.
Figure 6:
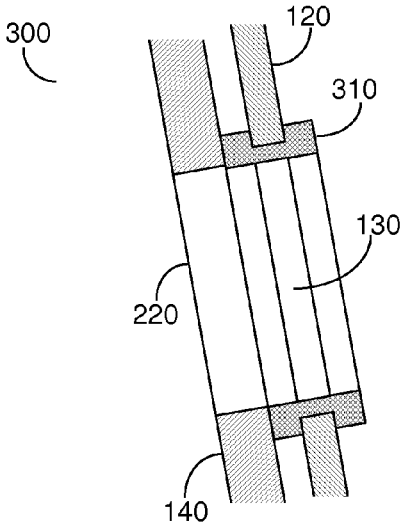
FIG. 6 is an enlargement of the area of the pouring nozzle in an opened position with a sealing o-ring.
Figure 7:
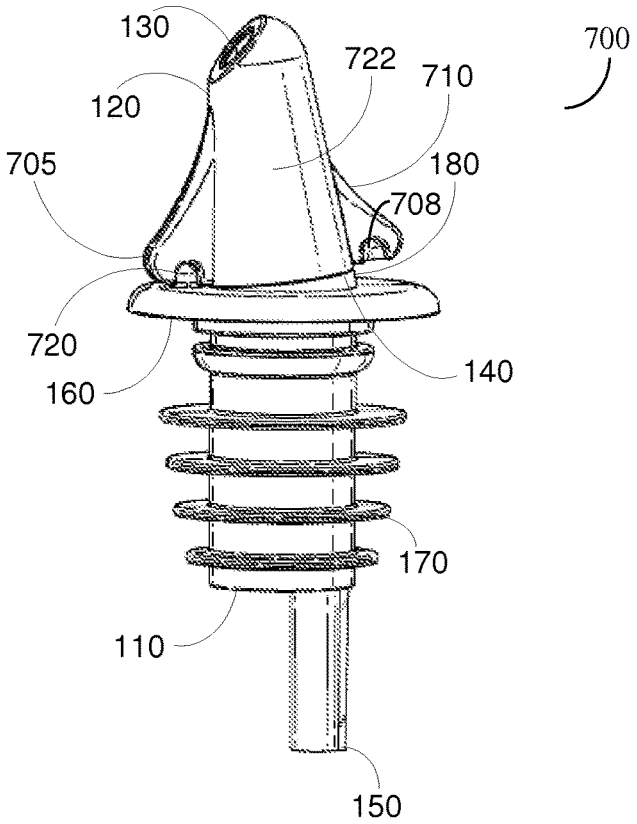
FIG. 7 is a right side isometric view of one embodiment of a sealable pourer assembly.
Figure 8:
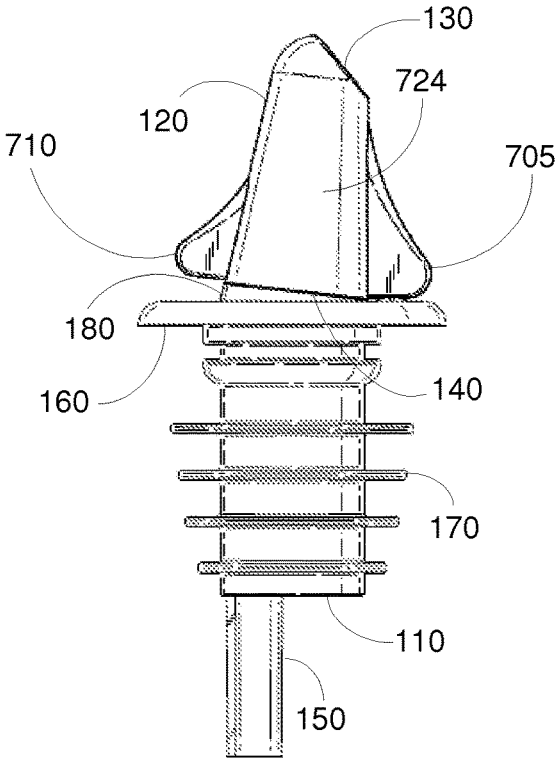
FIG. 8 is a left side elevation view thereof.
Figure 9:
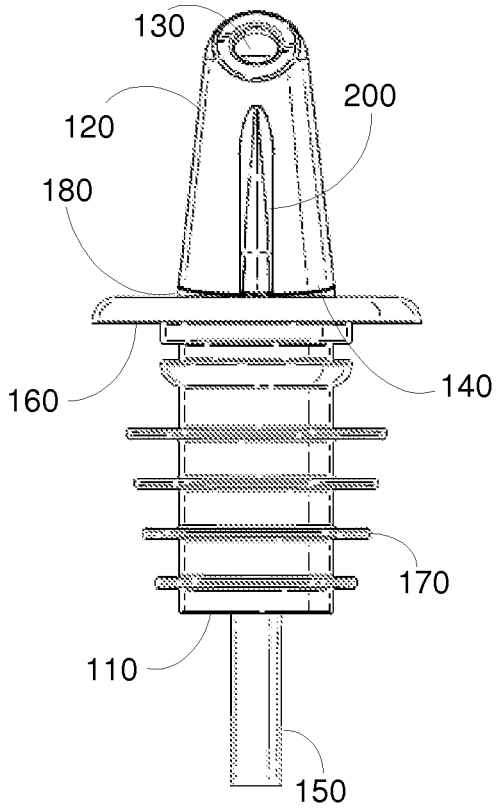
FIG. 9 is a front elevation view thereof.
Figure 10:
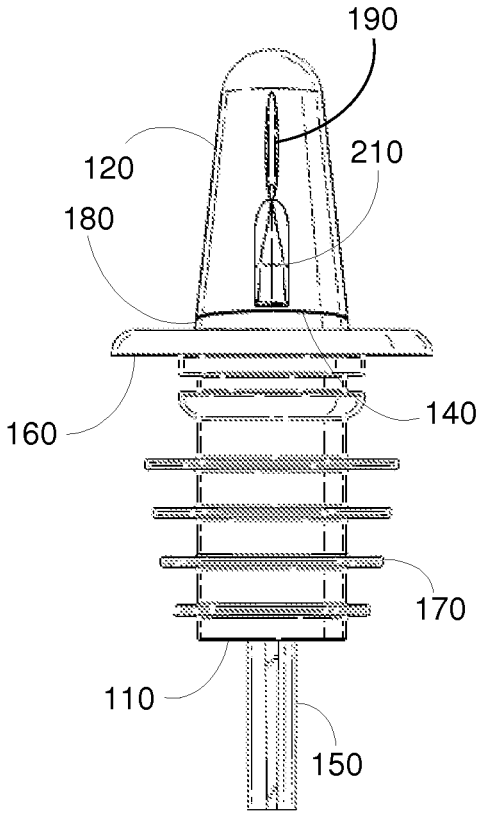
FIG. 10 is a rear elevation view thereof.
Figure 11:
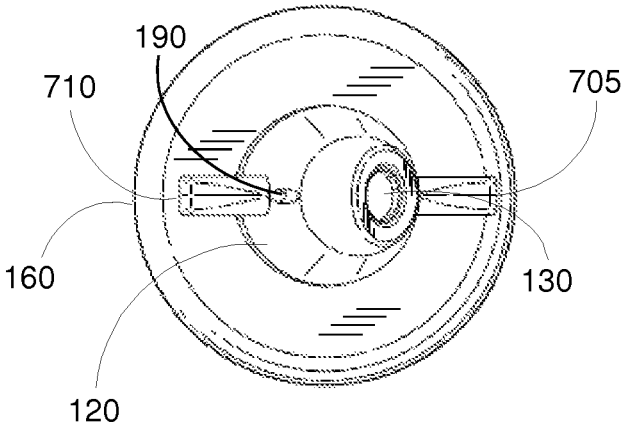
FIG. 11 is a top view thereof.
Figure 12:
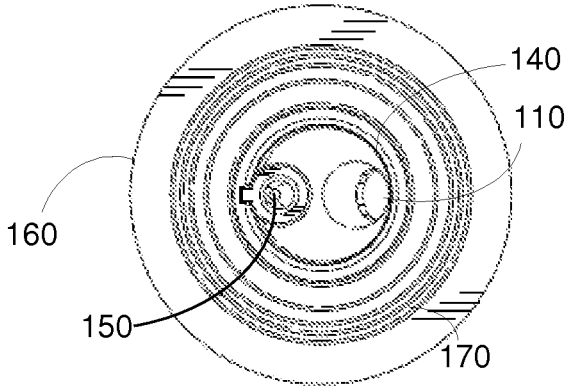
FIG. 12 is a bottom view thereof.
Figure 13:
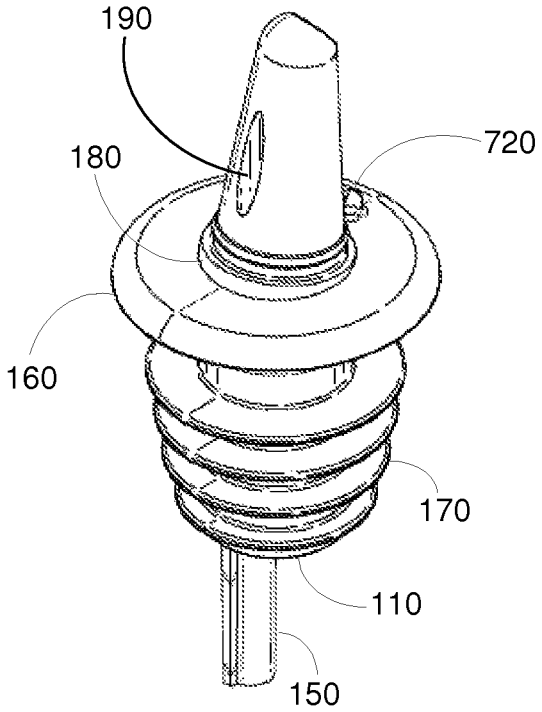
FIG. 13 is a left rear isometric view of another embodiment of a sealable pourer.
Figure 14:
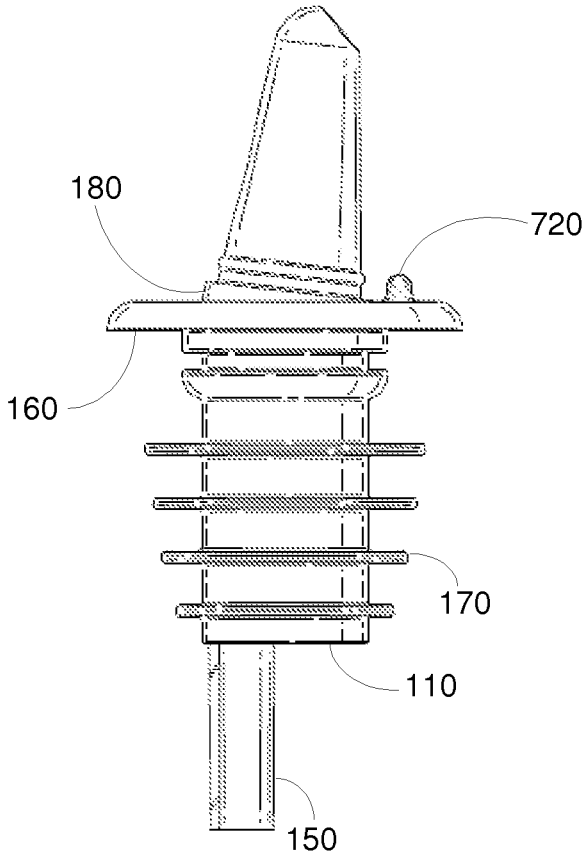
FIG. 14 is a left side elevation view thereof, the right side elevation being identical.
Figure 15:
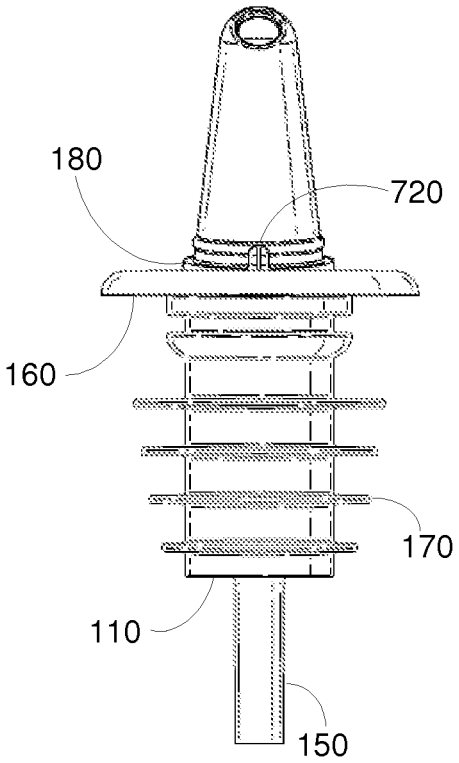
FIG. 15 is a front elevation view thereof.
Figure 16:
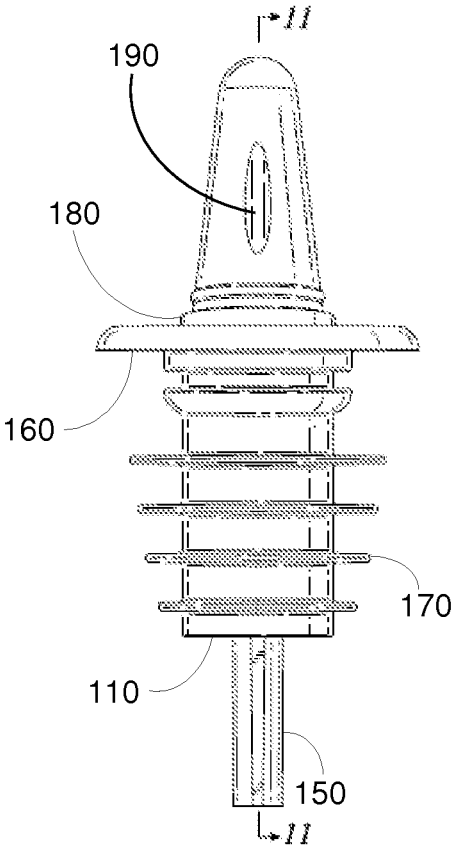
FIG. 16 is a rear elevation view thereof.
Figure 17:
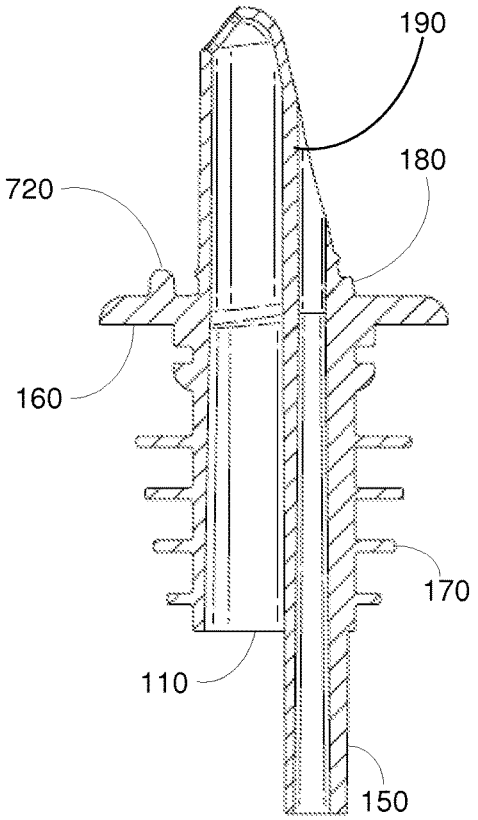
FIG. 17 is a cross-section taken along line 11-11 in FIG. 16.
Figure 18:
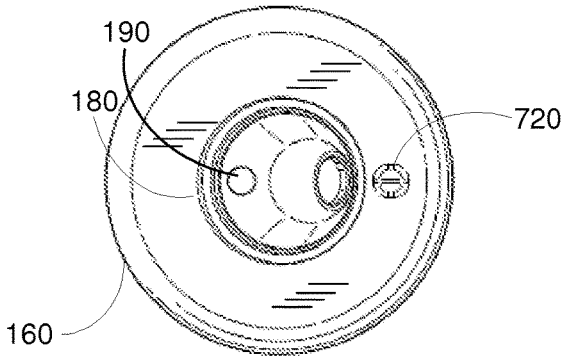
FIG. 18 is a top view thereof.
Figure 19:
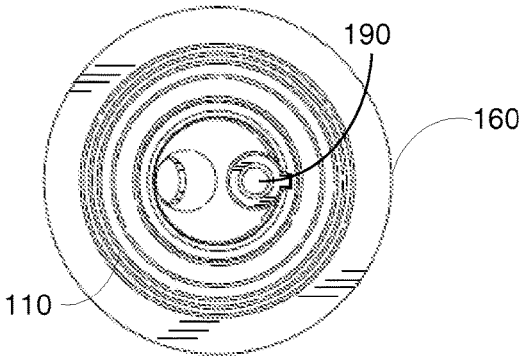
FIG. 19 is a bottom view thereof.
Figure 20:
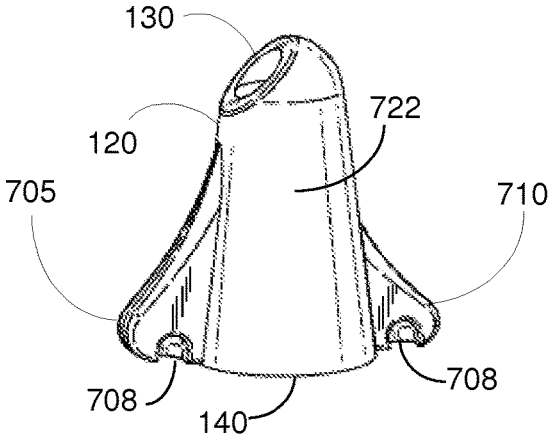
FIG. 20 is a right side isometric view of one embodiment of a cap of the sealable pourer.
Figure 21:
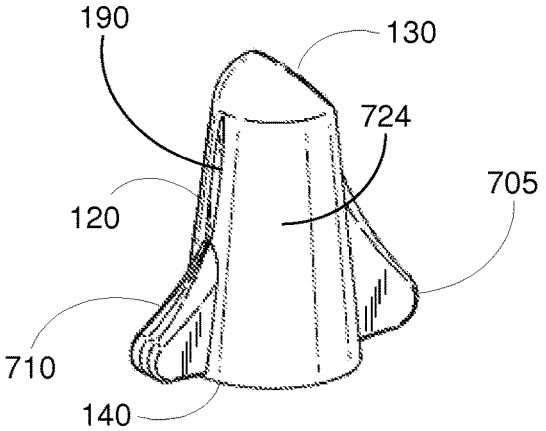
FIG. 21 is a left side isometric view thereof.
Figure 22:
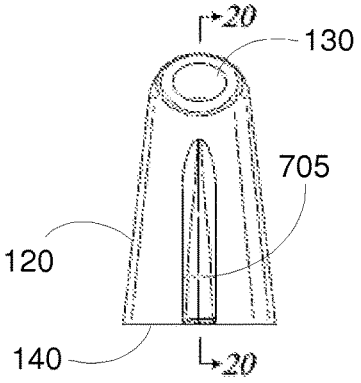
FIG. 22 is a front elevation view thereof.
Figure 23:
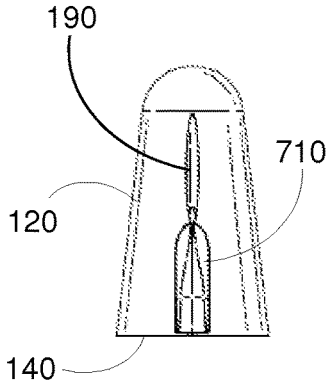
FIG. 23 is a rear elevation view thereof.
Figure 24:
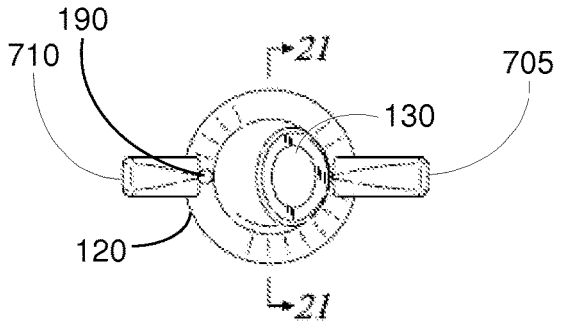
FIG. 24 is a top view thereof.
Figure 25:
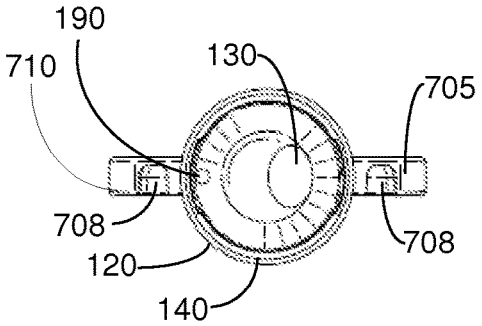
FIG. 25 is a bottom view thereof.
Figure 26:
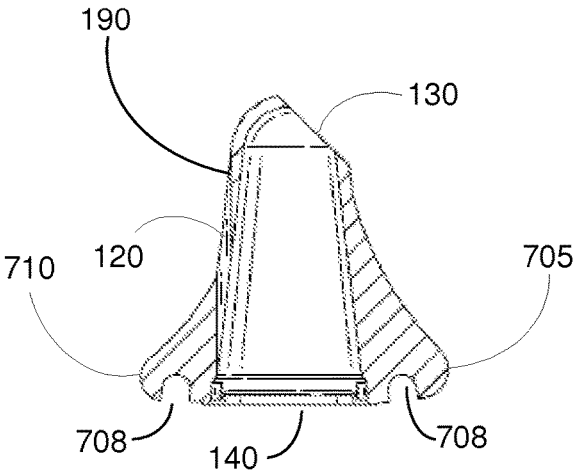
FIG. 26 is cross-section taken along line 20-20 in FIG. 22.
Figure 27:
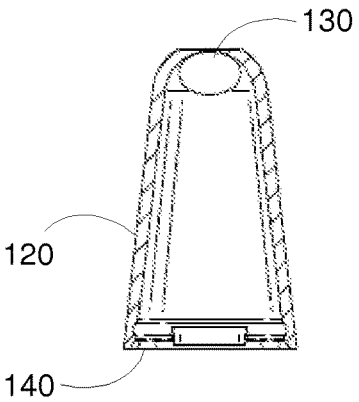
FIG. 27 is a cross-section taken along line 21-21 in FIG. 24.

FIGS. 4, 5, and 6 show various cross sections 200 and 300 of a portion of the pourer to further explain its operation. In FIG. 4, the cap 120 is in a sealed position. The cap 120 is further equipped with a rim 210 that corresponds to niches 708 in the nozzle 140 so that once the cap 120 is placed over the nozzle 140 it is generally locked in one of its two positions. It should be noted that the rim 210 may include an o-ring affixed on the cap 120.

The air tube 150 is shown to protrude through the side of the nozzle 140. In this position, both the air tube 150 and the nozzle orifice of the nozzle 140 are blocked by the cap 120. In FIG. 5, the cap is twisted about the symmetry axis 230 such that the first cap orifice 130 corresponds to the nozzle orifice of the nozzle 140 and the second cap orifice 190 corresponds to the air tube orifice of the air tube 150. In this position, pouring can occur.

To further enable tight sealing of the orifices, one of the orifices such as, for example, the first cap orifice 130, may be equipped with a sealing o-ring 220, as shown with respect to cross-section 300 of FIG. 6. In this embodiment, the o-ring is placed over the first cap orifice 130 to ensure sealing so that the beverage does not pour into the gap between the nozzle 140 and the cap 120. An o-ring may also be used with the second cap orifice 190. In one embodiment, the cap 120 is coated with a sealing material layer (not shown) to ensure better sealing between the nozzle 140 and the cap 120. Such a sealing layer may be made of various materials including, but not limited to, rubber, Teflon®, or any other appropriate sealing material. In yet another embodiment, the rim 210 is designed to allow locking of the cap 120 with respect to the nozzle 140 such that the cap cannot inadvertently swivel around the axis 230.

FIGS. 7 through 27 depict an embodiment of the pourer 700 wherein the cap 120 is equipped with turning wings, for example turning (twisting) wings 705 and 710, that may be appropriately positioned to allow the user to grip and move the cap 120 between the closed and opened positions of the pourer 700 with ease. A stopper 720 stops the twist of the cap 120 at the closed or opened positions. In an embodiment of the invention, a logo, an icon, a text, or the like, can be printed, embossed, or otherwise affixed to, for example, any one of the sides 722 or 724 of the cap 120.

Figure 28:
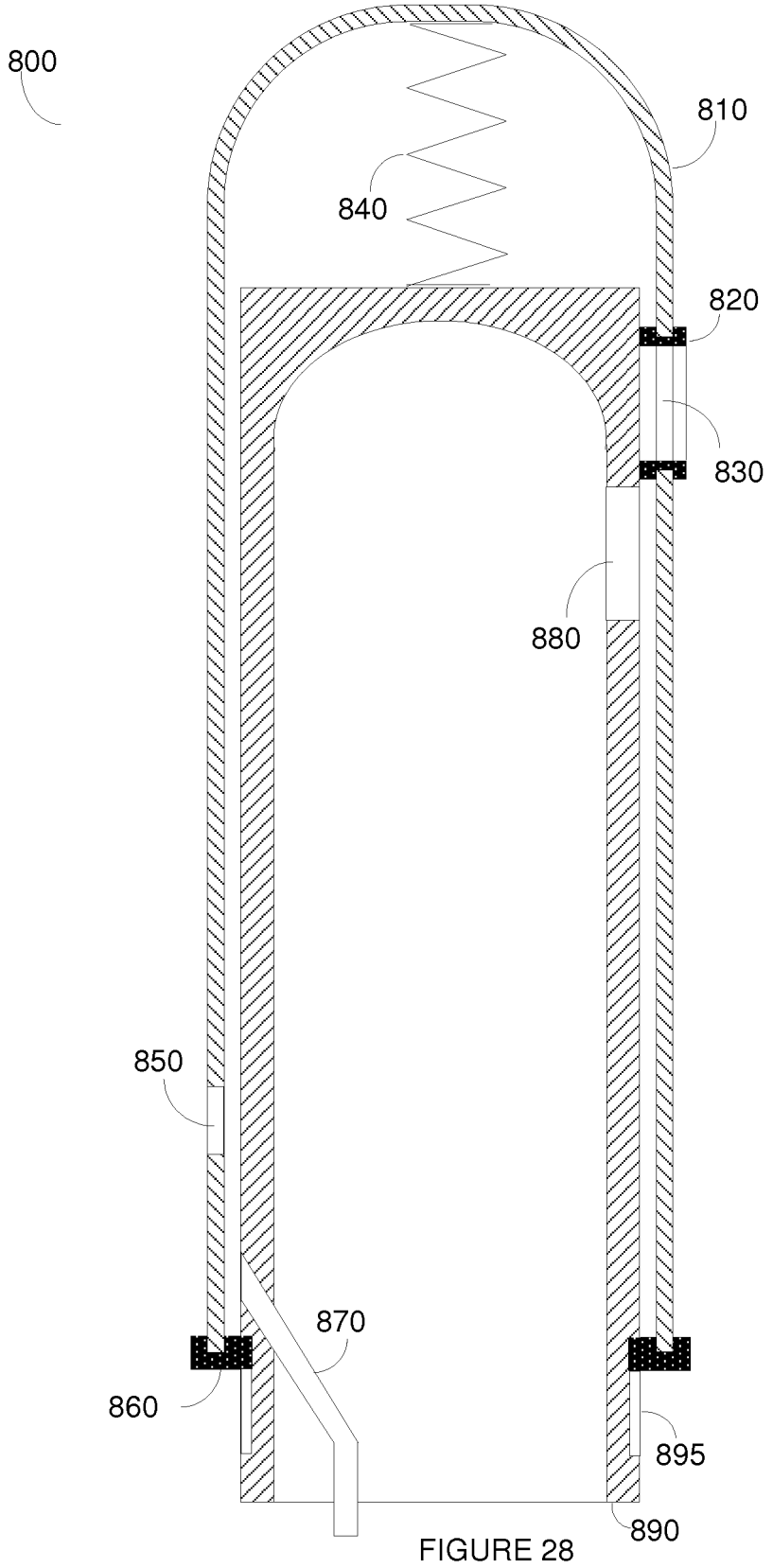
FIG. 28 is a schematic diagram of a portion of a pourer in accordance with an embodiment having a spring mounted sliding cap.

Another embodiment is shown in FIG. 28, which demonstrates an exemplary and non-limiting schematic diagram of a portion of a pourer 800 having a spring mounted sliding cap 810 that is biased toward the sealed position. For simplicity purposes only and without limitation, the upper portion of the pourer is shown, which can be affixed to the base 180 instead of the nozzle 140 as discussed with respect of FIGS. 1-27 above.

The nozzle 890 has a nozzle orifice 880 for the dispensing of the liquid. It is further equipped with an air tube 870 protruding through the side of the nozzle 890 to allow the flow of air into the container as explained in more detail herein above. The sliding cap 810 has a rim 860 to fit around the nozzle 890, fitting into a niche 895 to allow the sliding cap 810 to move up and down with respect of the slot 890. The sliding cap 810 is equipped with a first cap orifice 830 to correspond to the nozzle orifice 880 of the nozzle 890, and a second cap orifice 850 to correspond with the air tube 870. A spring 840 is mounted between the sliding cap 810 and the top of the nozzle 890. Upon pressing on the sliding cap 810, the spring 840 becomes depressed and the rim 860 slides within the slot 895, thereby depressing the spring 840. As a result, he first cap orifice 830 becomes aligned with the nozzle orifice 880 and the second cap orifice 850 becomes aligned with the air tube orifice of the air tube 870. Hence, with the sliding cap 810 in the depressed position, it is possible to pour the liquid, while in the released position the pourer 800 is sealed.

In one embodiment, a sealing o-ring is placed, for example, on the first cap orifice 820, for better sealing. In yet another embodiment, a locking mechanism (not shown) is used to lock the sliding cap in the depressed position when pressed downwards. In such an embodiment, a subsequent press releases the sliding cap, thereby allowing the sliding cap to return to its original and locked position. In another embodiment, the spring 840 is replaced by other means, such as pneumatic means, thereby enabling the depressing and release of the sliding cap 810 with respect to the nozzle 890.

A person skilled-in-the-art will readily note that other embodiments may be achieved without departing from the scope of the disclosed embodiments. For example, but not by way of limitation, other bases and/or engaging elements may be used to affix the nozzle to the opening of the container of a liquid. All such embodiments are included herein. The scope of the disclosed embodiments should be limited solely by the claims thereto.

While the present disclosure has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the disclosed embodiments. Furthermore, the foregoing describes the disclosed embodiments in terms of embodiments foreseen by the inventor for which an enabling description was available, notwithstanding that insubstantial modifications of the disclosed embodiments, not presently foreseen, may nonetheless represent equivalents thereto.

What is claimed is:

1. An apparatus for controlled pouring of a liquid, comprising:

a hollow cone-shaped nozzle having a nozzle orifice through which the liquid is poured, wherein the nozzle has a rotational symmetry at least with respect to outer walls of the nozzle;

an air tube protruding from the nozzle at a side that is opposite to the nozzle orifice, wherein the air tube protrudes beyond the nozzle, wherein the air tube allows at least an air flow when liquid is poured through the nozzle orifice; and a cap engaged with the nozzle having a first cap orifice generally conforming in shape to the nozzle orifice and a second cap orifice generally conforming in shape to the protruding air tube, wherein the second cap orifice is arranged in a longitudinal direction on the cap, an internal hollow of the cap having inner walls tightly conforming to the cone-shaped outer walls of the nozzle at any rotational position of the cap about the nozzle, the cap having a first position about the nozzle wherein the first cap orifice is not aligned with the nozzle orifice and the second cap orifice is not aligned with the protruding air tube, and the cap having a second position about the nozzle where the first cap orifice is aligned with the nozzle orifice and the second cap orifice is aligned with the protruding air tube of the nozzle, wherein, when the cap is in the first position, the liquid cannot be poured through the apparatus, and when the cap is in the second position, the liquid can be poured through the apparatus.

2. The apparatus of claim 1, further comprising:

an o-ring for sealing at least one of: the nozzle orifice, the first cap orifice, and the second cap orifice.

3. The apparatus of claim 1, wherein the internal hollow of the cap is coated with a sealing material layer.

4. The apparatus of claim 3, wherein the sealing material layer is rubber.

5. The apparatus of claim 1, further comprising:

a niche at least partially around the nozzle; and a rim at least partially around the inner wall of the cap, wherein the rim fits the niche around the nozzle.

6. The apparatus of claim 5, further comprising:

a locking mechanism to lock the cap into any one of: the first position, and the second position.

7. The apparatus of claim 5, wherein the rim is an o-ring affixed to the cap.

8. The apparatus of claim 1, wherein the cap is rotatable about a symmetry axis of the nozzle between the first position and the second position to achieve sealing of both the first cap orifice and the second cap orifice.

9. The apparatus of claim 8, wherein the motion of the cap about the rotational symmetry axis of the nozzle is restricted to between the first position and the second position.

10. The apparatus of claim 1, wherein the cap further comprises at least one of: a printed logo on at least one side, an embossed logo on at least one side, a printed icon on at least one side, an embossed icon on at least one side, a printed text on at least one side, and an embossed text on at least one side.

* * * * *